US012805672B2

(12) United States Patent
Pruche et al.

(10) Patent No.: US 12,805,672 B2
(45) Date of Patent: Nov. 24, 2026

(54) ASSEMBLY FOR CLEANING THE SKIN AND/OR KERATIN FIBERS

(71) Applicant: L'OREAL, Paris (FR)

(72) Inventors: Francis Pruche, Aulnay-sous-Bois (FR); Lucie Tournier-Couturier, Aulnay-sous-Bois (FR)

(73) Assignee: L'Oreal, Paris (FR)

( * ) Notice: Subject to any disclaimer, the term of this patent is extended or adjusted under 35 U.S.C. 154(b) by 582 days.

(21) Appl. No.: 18/265,538

(22) PCT Filed: Dec. 6, 2021

(86) PCT No.: PCT/EP2021/084449

§ 371 (c)(1),
(2) Date: Jun. 6, 2023

(87) PCT Pub. No.: WO2022/122673

PCT Pub. Date: Jun. 16, 2022

(65) Prior Publication Data

US 2024/0023763 A1 Jan. 25, 2024

(30) Foreign Application Priority Data

Dec. 7, 2020 (FR) ..... 2012797

(51) Int. Cl.
*A47K 7/00* (2006.01)
*A45D 24/26* (2006.01)
(Continued)

(52) U.S. Cl.
CPC ..... *A47K 7/043* (2013.01); *A45D 24/26* (2013.01); *A45D 19/02* (2013.01)

(58) Field of Classification Search
CPC ..... A47K 7/00; A47K 7/026; A45D 24/26; A45D 19/02
See application file for complete search history.

(56) References Cited

U.S. PATENT DOCUMENTS 1,113,843 A 10/1914 Smith
4,464,362 A 8/1984 Kludas et al.
(Continued)

FOREIGN PATENT DOCUMENTS

EP 0435341 A2 7/1991
EP 1597984 A1 11/2005
(Continued)

OTHER PUBLICATIONS

Boundless Book: Microbiology—LibreTexts, Jan. 2024, 19 pages.
(Continued)

*Primary Examiner* — Michael D Jennings
(74) *Attorney, Agent, or Firm* — The Marbury Law Group, PLLC

(57) ABSTRACT

Assembly for cleaning the skin and/or keratin fibers, comprising: •—a body (2) intended to contain a cleaning composition (S) for the skin and/or keratin fibers, comprising at least one wall (3) delimiting a volume forming a reservoir (4) for housing the cleaning composition (S), at least one supply orifice (5) to allow the cleaning composition (S) to exit from said body (2), •—at least one valve (6) making it possible to close or not close said at least one supply orifice (5), •—at least one pad (10, 10*a*, 10*b*) intended to be in contact with the skin and/or the keratin fibers, capable of being removably fixed to the body (2).

20 Claims, 14 Drawing Sheets

(51) Int. Cl.
*A47K 7/04* (2006.01)
*A45D 19/02* (2006.01)

(56) References Cited

U.S. PATENT DOCUMENTS

| | | | | |
|---|---|---|---|---|
| 6,190,671 | B1 | 2/2001 | Aubert et al. | |
| 10,285,494 | B1 | 5/2019 | Lho | |
| 11,399,626 | B2 * | 8/2022 | Chen | A46B 5/021 |
| 2015/0125412 | A1 | 5/2015 | Genard | |
| 2016/0331106 | A1 * | 11/2016 | Khormaei | A47K 7/043 |
| 2017/0086627 | A1 * | 3/2017 | Fang | A47K 7/043 |
| 2018/0084888 | A1 | 3/2018 | Kennedy et al. | |
| 2019/0104893 | A1 | 4/2019 | DeBlasi | |

FOREIGN PATENT DOCUMENTS

| | | | |
|---|---|---|---|
| EP | 2830588 | A1 | 2/2015 |
| FR | 2886845 | A1 | 12/2006 |
| FR | 2988607 | A1 | 10/2013 |
| FR | 3000383 | B1 | 7/2015 |
| FR | 3075644 | A1 | 6/2019 |
| JP | 3207092 | U | 10/2016 |
| KR | 20160000287 | U | 1/2016 |
| WO | 9402158 | A1 | 2/1994 |
| WO | 2008138839 | A2 | 11/2008 |
| WO | 2018108973 | A1 | 6/2018 |
| WO | 2019016212 | A1 | 1/2019 |
| WO | 2019035737 | A1 | 2/2019 |

OTHER PUBLICATIONS

Le Bihan, Cecile, "Utilisation des conservateurs dans les cosmétiques : un enjeu de santé publique, une résonance médiatique," Sciences du Vivant [q-bio], Jun. 2018, 99 pages.
Lefrancois, Margot, "Le développement d'un produit dermo-cosmétique destiné au jeune enfant : enjeux industriels et officinaux," Sciences pharmaceutiques, Jul. 2015, 264 pages.
Mintel—Balancing Lotion, Jul. 2015, 6 pages.
Mintel—Essence, Apr. 2010, 6 pages.
Mintel—Face Crème and Night Serum, Apr. 2014, 9 pages.
Mintel—Facial Serum, Feb. 2007, 3 pages.
Mintel—Firming Smoothing Lotion, May 2018, 5 pages.
Mintel—La Lotion Suprême, Jul. 2015, 4 pages.
Mintel—Lift & Firm Moisturizer, Mar. 2019, 5 pages.
Mintel—Real CICA Repair Complexion Cream—SPF30+++, Aug. 2020, 6 pages.
Mintel—Recovery Face Gel, Apr. 2020, 4 pages.
Mintel—Revitalizing Sea Serum, Jul. 2019, 7 pages.
Mintel—Softening gel, Jul. 2019, 4 pages.
Mintel—Visible Aging Repair Firming Rosy Cream, Mar. 2018, 6 pages.
Mintel—Visible Aging Repair Firming Rosy Day Cream, Oct. 2020, 3 pages.
Mintel—Visible Aging Repair Firming Rosy Rich Cream, Oct. 2020, 3 pages.
Montagnat-Rentier, Charlotte, "Vieillissement de la peau et les produits cosmétiques anti-âge actuels en pharmacie : la réglementation, leur composition, leur efficacité et l'attente des clients," Sciences pharmaceutiques, Feb. 2014, 158 pages.
Opposition in FR3117036, mailed Jan. 23, 2024, 35 pages.
Préchoux, Aurélie, "Modification des Propriétés Physico-Chimiques des Carraghénanes par la Purification et Caractérisation de Carraghénane-Sulfatases," Sciences du Vivant [q-bio]. Université Pierreet Marie Curie-UPMC, Apr. 2012, Français, 511 pages.
Non-Final Office Action for copending U.S. Appl. No. 18/265,540, dated Jul. 9, 2025.
Gamach, et al., "Carrageenan-induced brain inflammation," Journal of Neurosurgery, 65, 1986, pp. 679-685.
Cargill, "Satiagel VPC 512 texturizer," accessed Jun. 26, 2025, publication year 2015.
UniProt, "Taxonomy-Vitreoscilla filiformis," accessed Jun. 26, 2025, available Feb. 26, 2018, https://web.archive.org/web/20180226085715/http://www.uniprot.org:80/taxonomy/63 (Year: 2018).
Vittel Natural Mineral Water, Water is Life, accessed Jun. 27, 2025, available Aug. 14, 2020, https://web.archive.org/web/20200814220453/https://www.vittel.com/water-life (Year: 2020).
Gueniche, A. et al., "Effects of nonpathogenic gram-negative bacterium Vitreoscilla filiformis lysate on atopic dermatitis: a prospective, randomized, double-bline, placebo-controlled clinical study," British Journal of Dermatology, 159, pp. 1357-1363 (Year: 2008).
Gleick P., "Why Don't We Get Our Drinking Water from the Ocean by Taking the Salt out of Seawater?," Scientific American, accessed Jun. 27, 2025, publication date: Jul. 23, 2008, https://www.scientificamerican.com/article/why-don't-we-get-our-drinking-water-from-the-ocean/ (Year: 2008).
Bergey's Manual of Systematic Bacteriology, vol. 3, Sections 22 and 23, 9th Edition, 1989.
International Search Report in PCT/EP2021/084449, mailed Feb. 4, 2022, 3 pages.
International Search Report in PCT/EP2021/084451, mailed Mar. 14, 2022, 3 pages.
Santos et al., "Biosurfactants: Multifunctional Biomolecules of the 21st Century," International Journal of Molecular Sciences, Mar. 2016, vol. 17, No. 401, 31 pages.

* cited by examiner

ASSEMBLY FOR CLEANING THE SKIN AND/OR KERATIN FIBERS

CROSS REFERENCE TO RELATED APPLICATIONS

This is a National Stage Application of PCT/EP2021/084449, filed internationally on Dec. 6, 2021, which claims priority to French Application No. 2012797, filed on Dec. 7, 2020, both of which are incorporated by reference herein in their entireties.

TECHNICAL FIELD

The present invention relates to cleaning the skin and/or keratin fibers, such as the hair or a beard, in particular human ones, but also animal ones, in particular fur. In particular, the invention relates to an assembly for cleaning the skin and/or keratin fibers such as the hair or a beard. The invention also relates to a method for using this assembly for cleaning the skin and/or keratin fibers such as the hair or a beard.

PRIOR ART

The difficulty of being able to access running water or of having available a large volume of water is currently a reality for many people in the world and this difficulty might be accentuated in the coming decades from the viewpoint of climate change.

In this context, it is necessary to have available items of equipment which make it possible to consume less water, indeed even very little water, for common tasks for which we generally use a small amount or a great deal of water. This is a case with washing the body, for which we take baths or showers, consuming a large amount of water.

It thus appears necessary to make it possible to greatly reduce the use of water for cleaning the skin and/or keratin fibers.

Furthermore, the heating of a large amount of water is a source of $CO_2$ emission if the energy source is not renewable; the decrease in $CO_2$ emission is thus desirable.

U.S. Patent Publication 2018/084888 to Kennedy et al. relates to liquid applicators, particularly those used in hair care, and discloses a manifold dispensing cap having a base adapted to be attached to a bottle. The base seals the bottle and can move fluid from the interior of the bottle to a manifold. The manifold has a plurality of fingers which are evenly spaced radially from the centre where they extend outwardly. A central opening of the base acts as a supply port, and each finger is hollow having at its distal end an opening for the distribution of the fluid.

U.S. Pat. No. 10,285,494 to Lho discloses a fluid dispenser including a shell with a handle portion and an applicator portion opposite to the handle portion. The fluid dispenser includes a handle connected to the handle portion of the shell, and an applicator connected to the applicator portion of the shell. The applicator includes a base portion and a plurality of nodules extending from the base portion opposite to the handle portion of the shell. An interior cavity is formed between the applicator and the shell containing the fluid to be dispensed flowing from an orifice through at least one distribution orifice.

Japanese Utility Model No. 3,207,092 describes a brush for cleaning the skin and the scalp, comprising a reservoir, a handle, a plurality of guide portions in relief and a plurality of head portions, each being connected to a guide portion. The reservoir comprises an upper part and a lower part which can be made in one piece or in two separate pieces that can be assembled. The lower part is made of a rigid material and carries the guide portions, the latter being made in one piece with the lower part or being assembled with the latter. The guide portions are preferably made of a rigid material.

U.S. Pat. No. 1,113,843 to Smith describes a bottle secured to a hollow comb comprising teeth defining a passage terminated by an orifice. A valve secured to the comb closes the passage between the bottle and the comb.

There is a need to have available a new method of body cleaning, for the skin and/or keratin fibers, in particular human ones, capable of effectively replacing conventional aqueous body cleaning like, for example, showers, in particular hot showers, or baths, in particular hot baths.

DISCLOSURE OF THE INVENTION

The invention aims to meet this need and it achieves this by virtue, according to one of its aspects, of an assembly for cleaning the skin and/or keratin fibers, in particular human ones, such as the hair or a beard, comprising:

- a body intended to contain a cleaning composition for the skin and/or keratin fibers such as the hair or a beard, comprising at least one wall delimiting a volume forming a reservoir for housing the cleaning composition, at least part of said wall being elastically deformable, and at least one supply orifice to allow the cleaning composition to exit from said body,
- at least one valve making it possible to close or not close said at least one supply orifice,
- at least one pad intended to be in contact with the skin and/or keratin fibers such as the hair or a beard, capable of being removably fixed to the body, and having an outer surface on which cleaning projections and at least one dispensing opening are provided, said at least one supply orifice and said at least one dispensing opening being positioned respectively on the body and the pad so that, when the pad is fixed to the body, the cleaning composition can pass from the reservoir to said at least one dispensing opening by passing through said at least one supply orifice.

Thanks to the invention, we benefit from a new assembly for cleaning the skin and/or keratin fibers, such as human hair or beard or animal fur, that is sustainable and adapted to precisely overcome the use of a large amount of water for cleaning the skin and/or keratin fibers.

Specifically, such an assembly makes it possible to carry out cleaning by requiring little water, in particular only the water present in the cleaning composition, which makes it possible to dispense with the presence of a running water point or of a large amount of water for cleaning the skin and/or keratin fibers of a person. Such an assembly can thus be useful for carrying out the washing of a person with little or no mobility, and/or whenever there is a lack of water or when it is desired to save it. Specifically, the reservoir can accommodate a cleaning composition, and the cleaning projections allow independent and effective cleaning employing a rubbing and massaging action using the cleaning projections and without requiring the addition of water apart from the cleaning composition, in the manner of the washing performed by felines and other living creatures using their tongue and saliva.

Thanks to the presence of said at least one valve, the reservoir can be closed by closing off the supply orifice, in particular during the removal and fixing of the pad, which makes it possible to prevent the cleaning composition from flowing out of the reservoir in an uncontrolled manner, which also makes it possible to prevent any leakage of cleaning composition. When desired, in particular when using the assembly, once a pad is fixed to the body, the valve can be opened, making it possible to release the supply orifice which is no longer closed off, in order to allow the cleaning composition to pass out of the reservoir. This opening can be automatic and result from placing the cleaning composition under pressure.

The assembly may comprise at least two different pads suitable for being fixed alternatively to said body, comprising:

a pad provided for cleaning the skin, a pad provided for cleaning keratin fibers, the cleaning projections of the pad provided for cleaning the skin being at least in part different from the cleaning projections of the pad provided for cleaning keratin fibers.

Said at least one valve can be configured so as to allow the cleaning composition to be retained in the reservoir in the absence of pressure exerted on said at least one elastically deformable part of the wall and the cleaning composition to exit from the reservoir when pressure is exerted on said at least one elastically deformable part of the wall. The valve can thus be closed at rest and opened under the effect of the pressure exerted by the user when the latter presses on the body in order to reduce its interior volume.

Said at least one valve may be integral with the body in the absence of a pad. In other words, when the pad is separated from the body, the valve remains attached to the body.

Said at least one valve may have an axis oriented substantially perpendicularly to a longitudinal axis of the body. By axis of the valve, one should understand the direction along which the composition flows when the valve is open, the opening of the valve being caused by the pressure of the composition upwards the valve.

Said at least one valve has, for example, a base of annular shape and a shutter fixed to the base and comprising at least two elastically deformable membranes cooperating in the absence of pressure so as to prevent any exit of the cleaning composition from the reservoir and defining, between them, an opening when pressure is exerted on the elastically deformable part of the wall of the body in order to allow the cleaning composition to exit from the reservoir.

The assembly preferably comprises at least one retaining element arranged to cause the valve to cooperate with the supply orifice, the retaining element forming a ring of external diameter substantially equal to that of said supply orifice and of internal diameter substantially equal to the external diameter of a part of the valve, so as to externally maintain the valve and to internally cooperate with the supply orifice.

The body can be made of at least one elastically deformable material, in particular of one elastically deformable material, for example chosen from the group consisting of a thermoplastic elastomer (TPE), a high-performance elastomer (HPE), in particular a high-performance polyurethane elastomer or a high-performance thermoplastic elastomer, a polyurethane, a silicone and a polyamide, a biocellulose and a fungus mycelium. The material chosen is preferably chosen from biopolymers or bioplastics, that is to say comprising biodegradable polymers, polymers resulting from renewable sources, for example biobased (obtained by a process starting from plant matter), or polymers belonging to both these categories. The material chosen is preferably a recyclable or reusable polymer. The material can be chosen, for example, from the range of biopolymers sold under the name Terraprene®, thermoplastic elastomer (TPE) compounds, by FKUR Polymers, or else from the range of thermoplastic elastomers (TPEs) containing starting materials resulting from renewable plant products sold under the name Dryflex® Green by Hexpol, or else from the range of biobased thermoplastic elastomers (BioTPEs) sold by NaturePlast.

The or each pad can be made of at least one elastically deformable material, in particular of one elastically deformable material, for example chosen from the group consisting of a thermoplastic elastomer (TPE), a high-performance elastomer (HPE), in particular a high-performance polyurethane elastomer or a high-performance thermoplastic elastomer, a polyurethane, a silicone and a polyamide, a biocellulose and a fungus mycelium. The material chosen is preferably chosen from biopolymers or bioplastics, that is to say comprising biodegradable polymers, polymers resulting from renewable sources, for example biobased (obtained by a process starting from plant matter), or polymers belonging to both these categories. The material chosen is preferably a recyclable or reusable polymer. The material can be chosen, for example, from the range of biopolymers sold under the name Terraprene®, thermoplastic elastomer (TPE) compounds, by FKUR Polymers, or also from the range of thermoplastic elastomers (TPEs) containing starting materials resulting from renewable plant products sold under the name Dryflex® Green by Hexpol, or also from the range of biobased thermoplastic elastomers (BioTPEs) sold by NaturePlast.

The materials constituting the body and the pad can be identical or different, in particular as regards their elasticity.

The pad provided for the cleaning of the skin or at least the cleaning projections of this pad can be more flexible than the pad provided for the cleaning of the keratin fibers or at least than the cleaning projections of this pad.

The or each pad advantageously comprises, on an inner surface opposite to the outer surface, a fixing projection, the body having on an outer face a complementary fixing projection able to cooperate, in particular mechanically, with the fixing projection of the pad in order to fix the pad to the body.

In this case, the complementary fixing projection of the body can delimit, at least partially, a zone comprising said supply orifice(s).

Still in this case, the complementary fixing projection of the body comprises, for example, a flange extending toward the outside of the body with an at least partially closed contour, the contour of the flange having a shape similar to that of the outer contour of the fixing projection of the pad, which fixing projection can form a rim configured to hug the shape of the flange.

By virtue of the presence of fixing projections on the pad and on the body, which are capable of cooperating with one another, it is easy to secure and then detach the pad and the body, in particular when the pad and/or the body is/are made of at least one material elastically deformable at least at the fixing projection.

In order to facilitate the removal of the pad, the latter can comprise at least one tongue, in particular two tongues, making it possible to grasp the pad in order to remove it from the assembly, when desired. This or these tongues can be present at at least one longitudinal end of the pad, in particular extending from an inner surface of the pad.

The pad having a longitudinal axis, the body having a longitudinal axis, the longitudinal axis of the pad and the longitudinal axis of the body may make an angle less than 45°, preferably being substantially parallel.

The body preferably comprises a plurality of supply orifices, in particular five supply orifices, in order to make possible the discharge of the cleaning composition, said supply orifices being, for example, arranged in a row, in particular provided in order to extend substantially at the middle of the pad when the latter is fixed to the body. The supply orifices preferably are more than two, more preferably more than three, even more preferably more than four, and preferably less than ten, more preferably less than eight. The supply orifice(s) are traversing. Having a plurality of supply orifices may allow to reduce the size of each orifice and provide the user better control over the flow of the dispensed composition as well as a better surface distribution of the composition.

In the case where the supply orifices are arranged in a row and in the case where the pad extends along a curved longitudinal axis, said row can be substantially curved with a curvature similar to a curvature of said curved longitudinal axis of the pad.

The cleaning projections are designed to allow massage, rubbing or brushing of the skin and/or keratin fibers with the pad.

The cleaning projections may include barbs.

In one particular embodiment, the cleaning projections are formed by barbs.

At least some of the barbs are for example configured to imitate papillae of the tongue of a feline, in particular of a cat.

The term "barbs configured to imitate papillae of the tongue of a feline" is understood to mean barbs which each imitate the shape of a papilla of the tongue of a feline, for example being curved in a similar way to that of a papilla. Of course, some parameters of this shape can be adapted in order to be better suited in particular to human head hair or animal fur. In particular, the barbs of the pad can be harder and/or longer than the papillae. This can make it possible to ensure efficient brushing of human head hair, for example, by going as far as the scalp, which can thus also be massaged.

The dispensing opening can be formed on the outer surface of the pad or in one of the cleaning projections.

The assembly may comprise for each supply orifice a respective dispensing opening.

In the case where the cleaning projections comprise barbs, at least one barb can have a passage opening onto the dispensing opening.

In this case, the passage of said at least one barb which opens onto the dispensing opening can pass through the barb from an end connected to the outer surface of the pad up to a free end, the free end comprising the dispensing opening for the dispensing of the cleaning composition.

All or some of the barbs can have a shape with a diameter which decreases from the end connected to the outer surface of the pad up to the free end.

Said at least one pad comprises, for example, barbs of at least one first shape and barbs of at least one second shape, differing in particular from the first shape in the diameter, the shape of the free end, the length and/or the straight or curved longitudinal axis along which the barbs extend between their end connected to the pad and their free end.

At least some of the barbs, or even all of the barbs, of the pad, in particular the pad provided for the cleaning of the keratin fibers, can have a curved shape, the longitudinal axis of said barb(s) then being curved.

At least some of the barbs, in particular all of the barbs, of the pad, in particular the pad provided for the cleaning of the skin, can have a rectilinear shape, in particular of substantially conical shape.

A region of the outer surface of the pad, in particular of the pad provided for cleaning the skin, is, in one particular embodiment, devoid of barbs, said region being for example provided with at least one lamella, in particular with a plurality of lamellae, extending substantially orthogonally from said outer surface. In this case, the cleaning projections comprise barbs in one region of the outer surface of the pad, and lamellae in another region of the outer surface of the pad.

Such lamellae can have a scraping effect on the skin, for example to remove remaining cleaning composition and/or dead skin cells or other impurities. The lamellae can be arranged parallel to one another and/or parallel to the outer edge or contour of the outer surface of the pad in said region. It is understood that the parallelism can concern curved lines, which are thus equidistant over their entire length. The barbs can extend along rows, for example in the extension of the lamellae, when present, distributed over another region of the pad.

The pad can extend along a curved longitudinal axis, it being possible for said body to then have, at least in a part intended to cooperate with the pad, a similar curved shape.

Such a shape can be ergonomic for handling and using the assembly.

The body can extend from a lower end up to an upper end, along a longitudinal axis, which is preferably curved, the body comprising a base portion comprising in particular a gripping part, including the lower end, and an upper portion comprising the upper end, a width of the base portion being greater than a width in the upper portion, the width of the upper portion preferably continually decreasing in the direction of the upper end.

The upper portion may include the part of the body which is intended to cooperate with the pad and may include, where appropriate, at least part of said complementary fixing projection.

The body can comprise, in a rear part, the gripping part and, in a front part opposite to the rear part, said complementary fixing projection.

The body preferably has an ergonomic shape, for example suited to the user, in particular in the gripping part.

Furthermore, the body advantageously comprises an opening for filling the cleaning composition, the assembly comprising an at least partially removable stopper arranged to close said filling opening.

In this case and in the case where the body comprises a base portion having a lower end, the filling opening is preferably located at a lower end of the body, in particular at a lower end of the base portion of the body.

The filling opening can be defined by a skirt extending inside or outside the reservoir.

An adapting piece can be inserted between the stopper and the body so as to make it possible to cause the stopper and the body to cooperate with one another. For example, the adapting piece can be fitted by force or by snap fastening to the skirt extending outside the reservoir and defining the filling opening. The adapting piece can comprise a skirt extending substantially parallel to the skirt of the body and having an external thread capable of cooperating with a corresponding thread present on an inner skirt of the stopper in order to be able to close the filling opening.

The lower end of the assembly can be flat and wide enough to be able to rest on a flat support and allow the assembly to be maintained without requiring the intervention of a person.

The body can comprise an air intake orifice. Such an orifice can be provided with a valve, in particular with a valve similar to that which equips the supply orifice(s) for the discharge of cleaning composition.

The assembly can comprise a cleaning composition contained in the reservoir. Such a cleaning composition can be suitable for cleaning the body and/or keratin fibers. The cleaning composition is preferably low-foaming or even nonfoaming, so as to prevent the development of foam within the assembly which may interfere with the operation thereof.

The shape and dimensions of the assembly are preferably adapted for good handling by the user. The total height of the body of the assembly can in particular be between 5 cm and 20 cm, in particular between 7 cm and 13 cm. The capacity of the reservoir can be between 3 cl and 20 cl approximately, in particular between 4 cl and 15 cl. The width of the assembly can be between 3 cm and 8 cm, in particular about 5 cm. The depth, from the front to the rear, of the assembly can be between 3 cm and 10 cm, for example, in particular between 7 and 9 cm, it being possible, of course, for this depth to depend on the pad which is fixed to the body.

Another subject of the invention, according to another of its aspects, in combination with the foregoing, is a pad intended to be in contact with the skin and/or the keratin fibers, capable of being removably fixed to the body of the assembly, and having an outer surface on which are provided cleaning projections and at least one dispensing opening, said at least one dispensing opening being positioned on the pad so that, when the pad is fixed to the body, the cleaning composition can pass from the reservoir to said at least one dispensing opening.

Another subject of the invention, according to another of its aspects, is a method for using the assembly as defined above, for cleaning the skin and/or keratin fibers, comprising the following steps:

filling the reservoir with a cleaning composition, pressing the body to allow the opening of said at least one valve and the dispensing of cleaning composition through the dispensing opening, bringing the cleaning projections and the cleaning composition into contact with the skin and/or the keratin fibers, where appropriate, carrying out, with the cleaning projections, massaging, combing, brushing or rubbing of the skin or keratin fibers wetted with cleaning composition.

When one or more lamellae are present on the pad, it is also possible to carry out scraping of the skin.

When the body comprises an air intake orifice provided with a valve, said valve can be arranged in order to open when the user stops pressing on the body so as to make possible the entry of air. The body can then return to its initial shape.

Another subject of the invention, according to another of its aspects, in combination with the foregoing, is a method for manufacturing the body of an assembly as defined above for cleaning the skin and/or keratin fibers, the manufacturing method comprising the following steps:

collecting of at least one image of a user's hand, processing the data of said at least one image, calculating, from these data, a body shape adapted, in particular in a gripping part of the body, to the user's hand, manufacturing said body using a method for the additive manufacturing of polymer materials.

BRIEF DESCRIPTION OF THE DRAWINGS

A better understanding of the invention can be obtained on reading the detailed description which will follow of nonlimiting exemplary embodiments thereof and on examining the appended drawing, in which.

DETAILED DESCRIPTION

In the remainder of the description, identical elements or identical functions carry the same reference sign. For the purposes of conciseness of the present description, they are not described in relation to each of the figures, only the differences between the embodiments being described.

In the figures, the actual proportions have not always been respected, for the sake of clarity.

Figure 1:
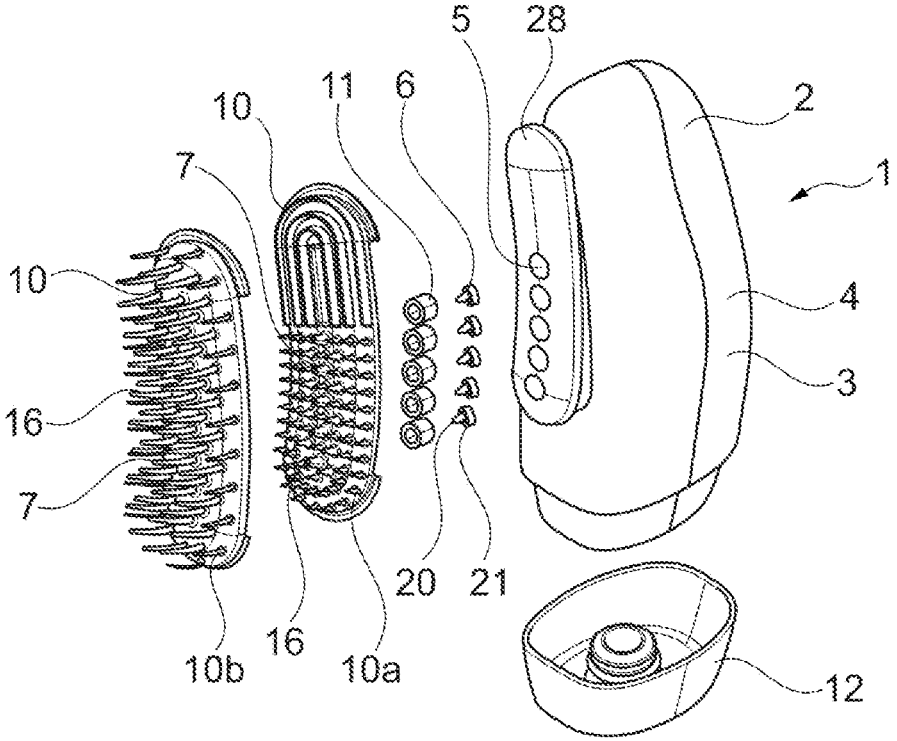
FIG. 1 shows, in a schematic exploded view and in perspective, an example of an assembly according to the invention.

A description will be given of a first embodiment in the light of FIGS. 1 to 19. FIG. 1 illustrates an example of an assembly 1 for cleaning the skin and/or keratin fibers, such as the hair or a beard, according to the invention, comprising a body 2 intended to contain a cleaning composition for the skin and/or keratin fibers. The body 2 comprises at least one wall 3 delimiting a volume forming a reservoir 4 for housing the cleaning composition. At least part of the wall 3 is elastically deformable. The body 2 also comprises at least one supply orifice 5, in the example illustrated five supply through-orifices 5, to allow the cleaning composition to exit from the body 2.

The assembly 1 also comprises at least one valve 6, in this example five valves 6 each capable of closing or not closing one of the supply orifices 5.

The assembly 1 also comprises at least one pad 10, in this example two pads 10, respectively 10*a* and 10*b*, intended to be in contact, for the purposes of cleaning, with the skin and/or the keratin fibers. In the example illustrated, the pad 10*a* is intended to be in contact with the skin, while the pad 10*b* is intended to be in contact with the keratin fibers.

Each pad 10 is capable of being removably fixed to the body 2 and has an outer surface 15 comprising cleaning projections 7 comprising, in this example, barbs 16.

Figure 11:
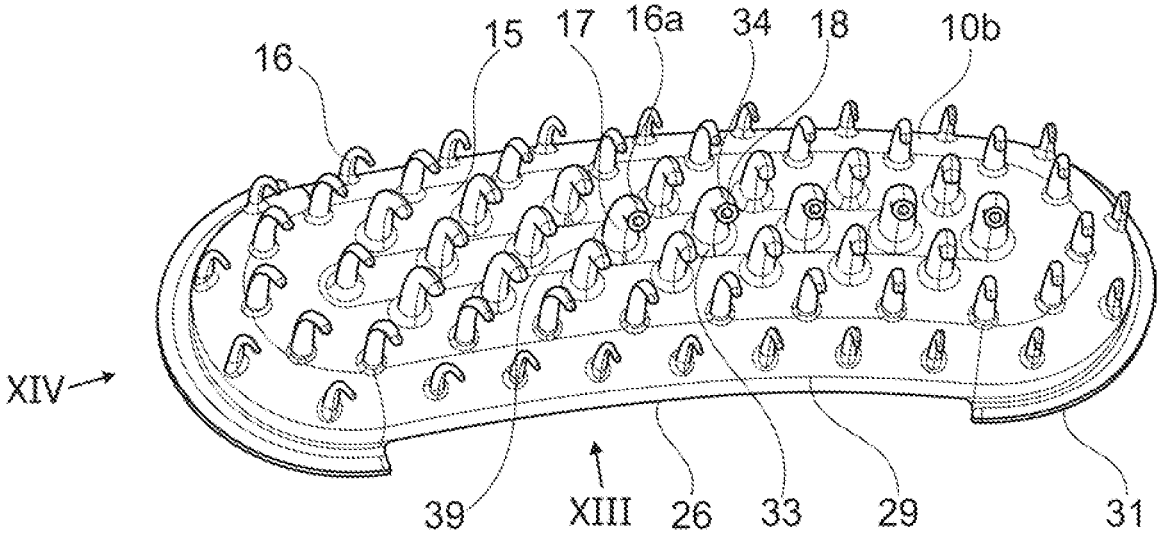
FIG. 11 shows, in isolation, schematically and in perspective, the second pad of FIGS. 4 and 5.
Figure 15:
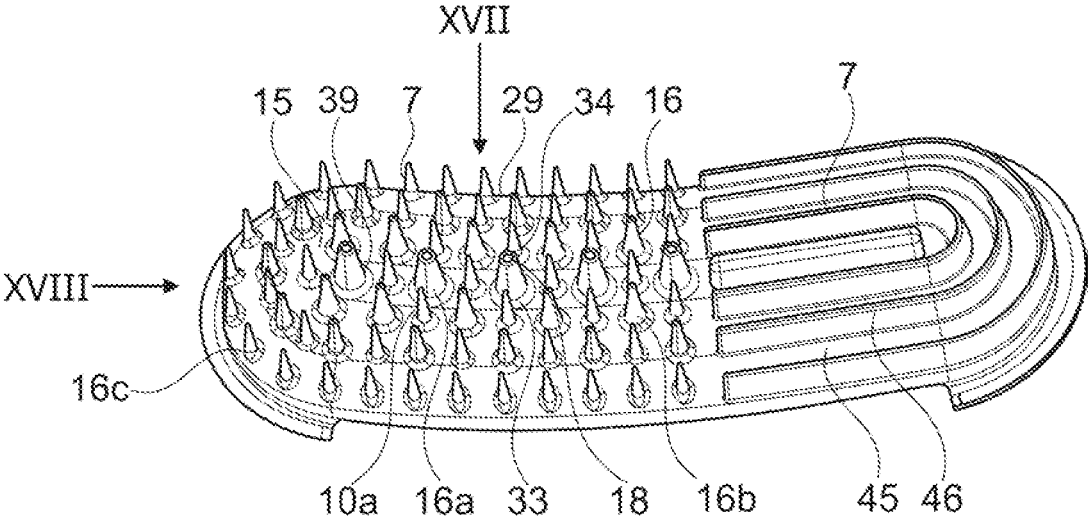
FIG. 15 shows, schematically and in perspective, in isolation, the first pad of FIGS. 2 and 3, FIG. 16 schematically shows the interior of the pad of FIG. 15.

In the example illustrated, at least one barb 16, referenced 16*a*, as visible more precisely in FIGS. 11 and 15, in this example five barbs 16*a*, has a passage 17 opening onto a dispensing opening 18 for dispensing the cleaning composition. This barb 16*a* is positioned on the pad 10 such that, when the pad 10 is fixed to the body 2, the supply orifice is positioned relative to the barb 16*a* to allow the dispensing of the cleaning composition from the reservoir 4 to the dispensing opening 18.

As can be seen in FIG. 1, and as will be described below, the barbs 16 of the pad 10*a* are at least in part different from the barbs 16 of the pad 10*b*.

Still in FIG. 1, there can be seen the presence, in the assembly 1, of retaining elements 11 forming rings intended to allow cooperation between the valves 6 and the shutters 5. Each retaining element 11 is thus arranged to cause the valve 6 to cooperate with a corresponding supply orifice 5. Each retaining element 11 forms a ring with an external diameter substantially equal to that of the supply orifice 5 and with an internal diameter substantially equal to the external diameter of a part of the valve 6, so as to externally maintain the valve 6 and to cooperate internally with the supply orifice 5. This arrangement is visible more particularly in FIG. 10.

Figure 10:
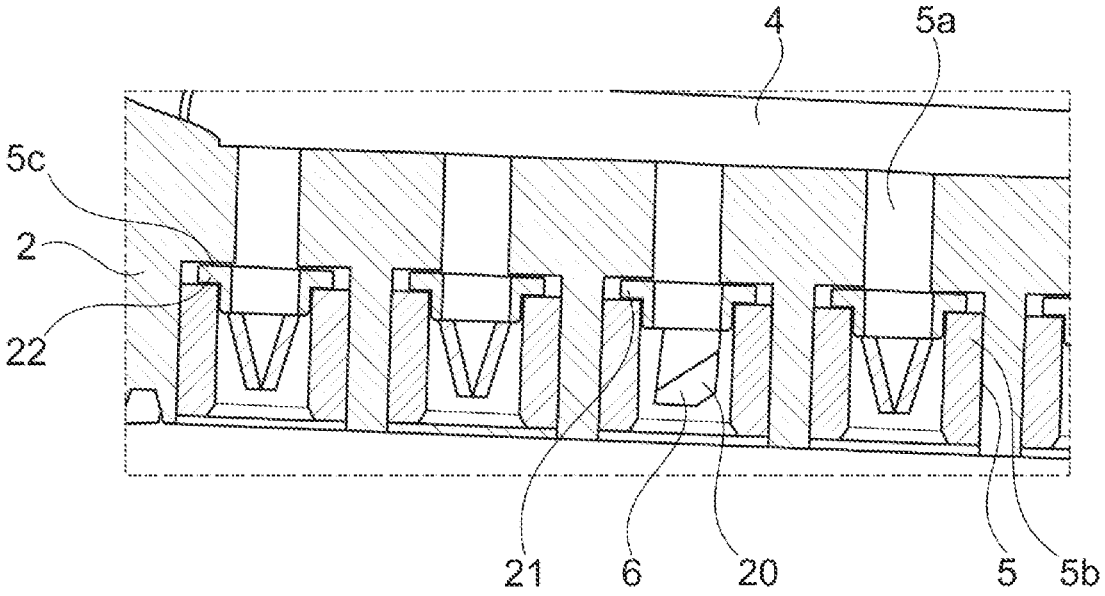
FIG. 10 is a schematic and partial view in longitudinal section of the assembly of FIG. 1, once mounted.

Each valve 6 is configured so as to allow the retention of the cleaning composition in the absence of pressure exerted on the wall 3 in its elastically deformable part and the exit of cleaning composition when pressure is exerted on the elastically deformable part of the wall 3. As visible in FIG. 1 and FIG. 10, each valve 6 has in this example a base 21 of annular shape with one end 22 of the base having a larger diameter than the rest of the base. The valve 6 also has a shutter 20 fixed to the base 21, the shutter comprising in this example two elastically deformable membranes cooperating in the absence of pressure so as to prevent any passage of the cleaning composition and defining an opening between them when pressure is exerted on the elastically deformable part of the wall 3 of the body 2 to allow the cleaning composition to pass. As can be seen in FIG. 10, each supply orifice 5 comprises a first supply orifice portion 5*a*, on the reservoir 4 side, and a second supply orifice portion 5*b*, of diameter greater than that of the first portion 5*a*, extending in the axial continuation thereof. A shoulder 5*c* connects the first portion 5*a* to the second portion 5*b*. The second portion 5*b* houses the valve 6. The end 22 of the base 21 of the valve 6 bears axially against the shoulder 5*c*. The retaining element 11 inserted into the second portion 5*b* of the supply orifice itself bears axially against the end 22 and transversely against the rest of the base 21.

Figure 8:
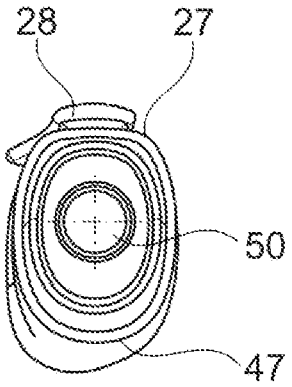
FIG. 8 shows, schematically, in a bottom view, the body of FIG. 6.
Figure 9:
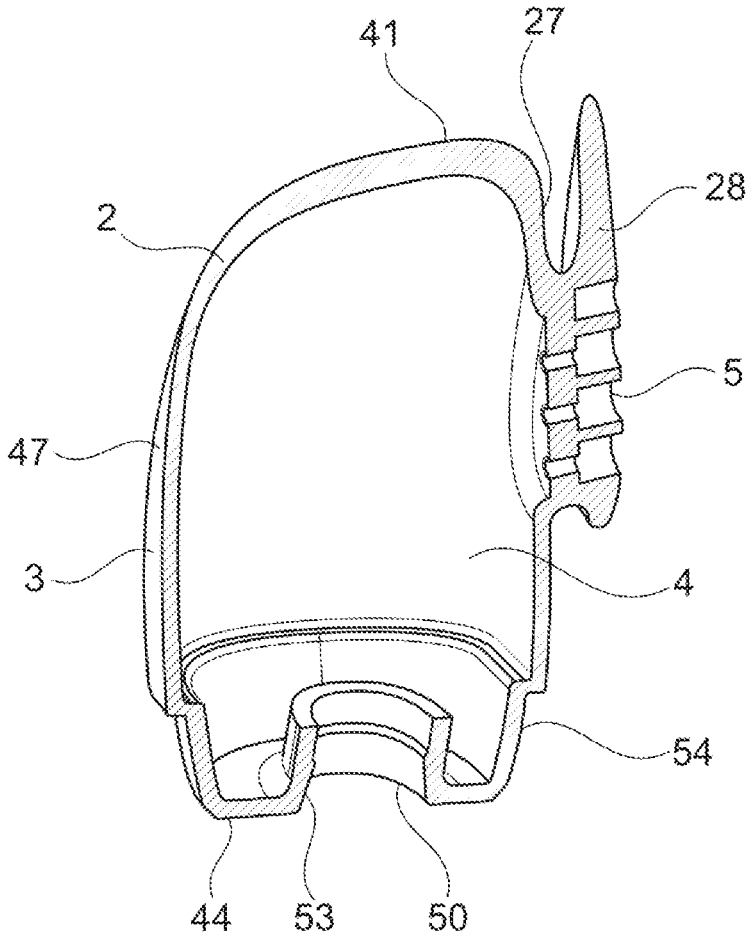
FIG. 9 is a view in longitudinal section and in perspective of the body of the assembly of FIG. 7.
Figure 19:
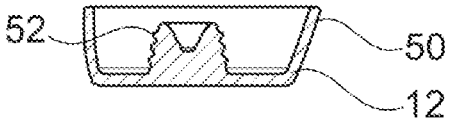
FIG. 19 shows, schematically and in isolation, in longitudinal section, the stopper of the assembly of FIG. 1.

The assembly 1 also comprises a stopper 12, visible in FIG. 1 and in isolation in FIG. 19, intended to cooperate with a filling opening 50, visible in FIGS. 8 and 9, to allow the reservoir 4 to be filled with cleaning composition.

The body 2 is made entirely of an elastically deformable material in the example illustrated, in particular of a high-performance biobased elastomer, that is to say obtained by a process proceeding from plant material, in this example consisting of a thermoplastic elastomer (TPE) from the range of bioTPEs sold by NaturePlast, being produced in one piece by material injection molding. Likewise, the pads 10 are entirely made of at least one elastically deformable material, also of high-performance biobased elastomer in this example consisting of a thermoplastic elastomer from the range marketed under the name Dryflex® Green sold by Hexpol, each also produced in one piece by material injection molding.

Figure 2:
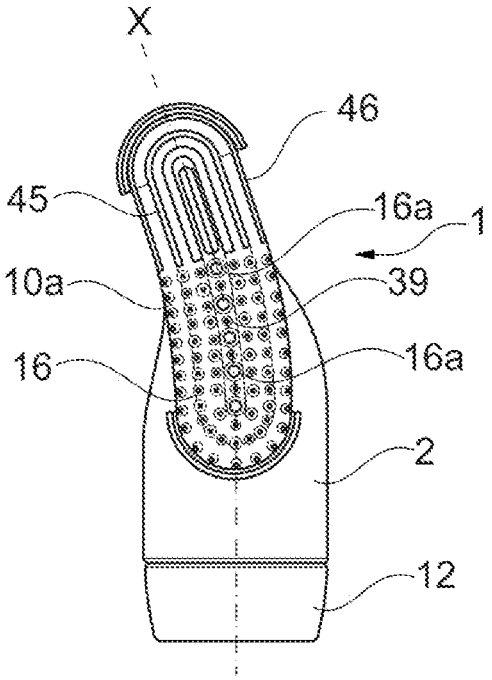
FIG. 2 shows, in a front view, schematically, the assembly of FIG. 1 mounted with a first pad.
Figure 3:
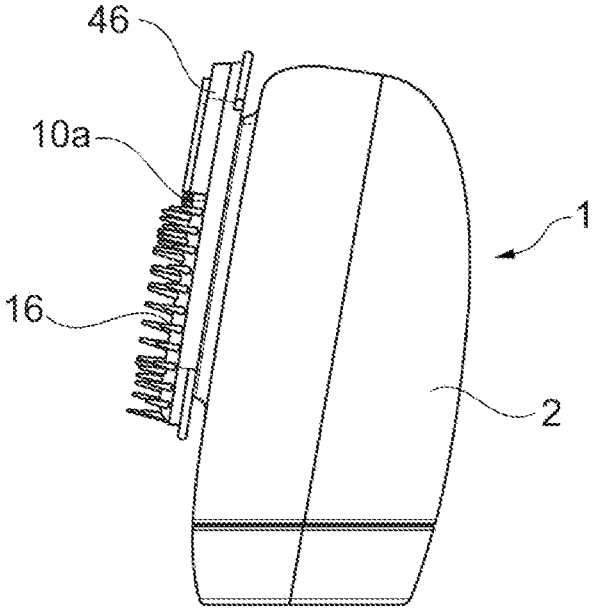
FIG. 3 shows, in a side view, schematically, the assembly of FIG. 2.
Figure 4:
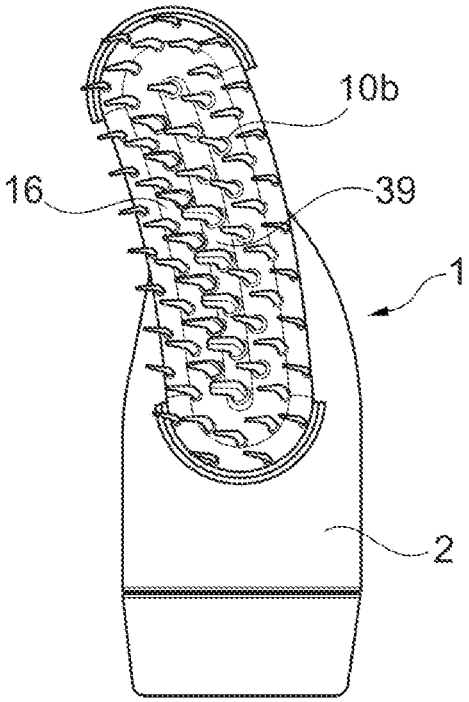
FIG. 4 shows, in a front view, the assembly of FIG. 1 mounted with a second pad.
Figure 5:
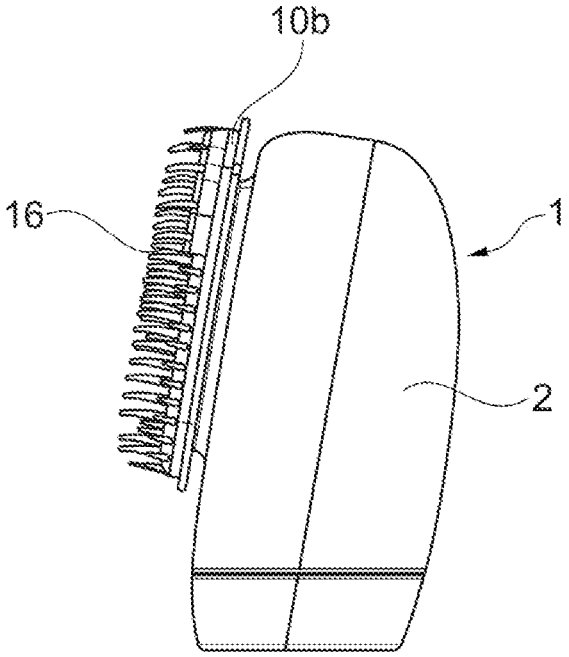
FIG. 5 shows, in a side view, schematically, the assembly of FIG. 4.

FIGS. 2 and 3 show the assembly 1 assembled with the pad 10*a* mounted on the body 2. It can be seen in particular in this figure that, in this example, the pad 10*a* and the body 2 extend along a curved longitudinal axis X. FIGS. 4 and 5 show the assembly 1 assembled with the pad 10*b* mounted on the body 2. The pad 10*b* also extends along the curved longitudinal axis X. The pads 10*a* and 10*b* have overall shapes and an outer contour which are substantially similar.

Figure 12:
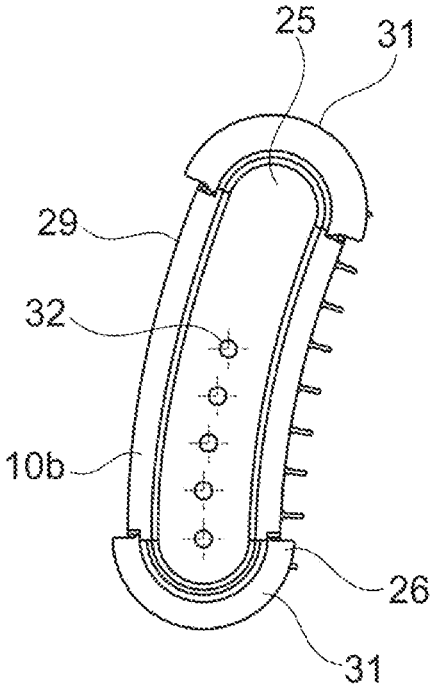
FIG. 12 is a schematic view of the interior of the pad of FIG. 11.
Figure 16:
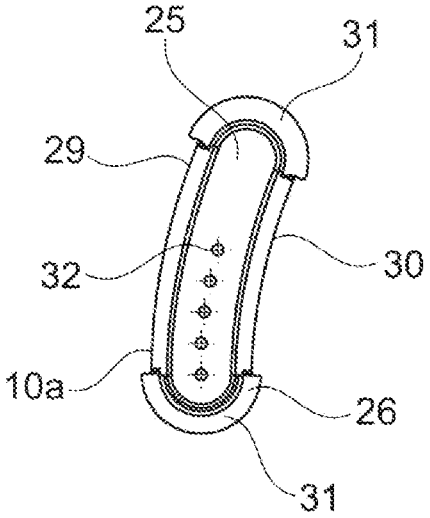

For the removable fixing of the pad 10*a* or of the pad 10*b* to the body 2, as visible in FIGS. 16 and 12, respectively, the pads 10*a* and 10*b* comprise, on a lower surface 25 opposite to the outer surface 15, a fixing projection 26.

For its part, as visible in particular in FIGS. 1, 6, 7, 8 and 9, the body 2 has on a front part 27 a complementary fixing projection 28 able to cooperate, in this example mechanically, with the fixing projection 26 of the pads 10*a* and 10*b* for the removable fixing of these pads 10*a* and 10*b*, alternatively, to the body 2.

In the example illustrated, the complementary fixing projection 28 forms a flange extending toward the outside of the body 2 and having a contour 35, substantially in the shape of a bean, which is closed around a zone 36. The contour 35 of the flange has a shape similar to that of the outer contour 29 of the pads 10.

In the example illustrated, tongues 31 are formed at the longitudinal ends of the pad 10 to facilitate the gripping of the pad 10, in particular for its removal from the body 2.

In FIGS. 12 and 16 there can be seen the openings 32 formed in the pad 10*b* or respectively. These openings 32 continue through the passage 17 made in the five barbs 16*a* to allow the cleaning composition to pass.

The passage 17 of each barb 16*a*, as can be seen in particular in FIGS. 11 and 15, opens onto the dispensing opening 18 for dispensing the cleaning composition. The passage 17 passes, in the example illustrated, through the barb 16*a* from one end 33 of the barb 16*a* connected to the outer surface 15 of the pad 10 to a free end 34 of the barb 16*a*. The free end 34 comprises the dispensing opening 18 for the discharge of the cleaning composition.

Figure 6:
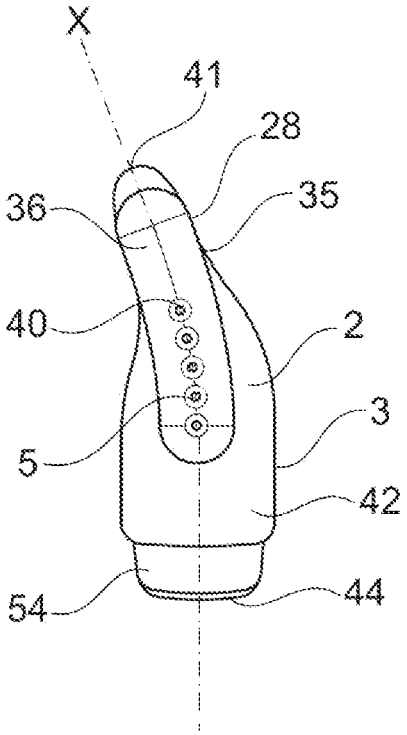
FIG. 6 shows, schematically and in isolation, in a front view, the body of the assembly of FIG. 1.
Figure 7:
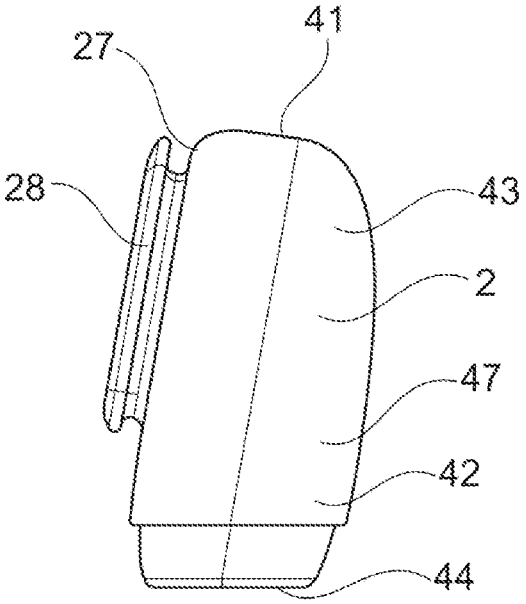
FIG. 7 shows, schematically, in a side view, the body of FIG. 6.

The supply orifices 5 are arranged on the body 2 in this example, as can be seen in particular in FIG. 1 or 6, in a row 40 provided to extend substantially in the middle of the pad 10 when the latter is fixed to the body 2. In the example illustrated, the pad 10 extends along a curved longitudinal axis X. In this case, the row 40 is also substantially curved, along the axis X with a curvature similar to a curvature of the curved longitudinal axis X of the pad 10. The barbs 16*a* are arranged on the pads 10*a* and 10*b* also in a row 39, in an identical manner, as can be seen for example in FIGS. 2, 4, 11 and 15, to allow good correspondence between the supply orifices 5 and passages 17.

Figure 13:
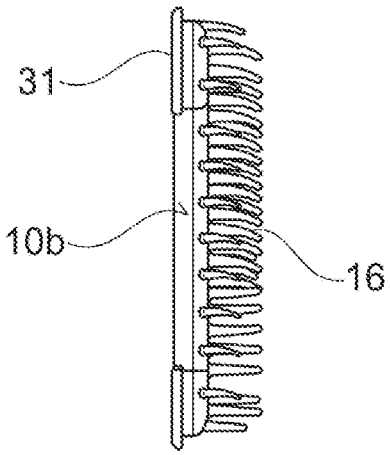
FIG. 13 is a schematic side view along XIII of the pad of FIG. 11.
Figure 14:
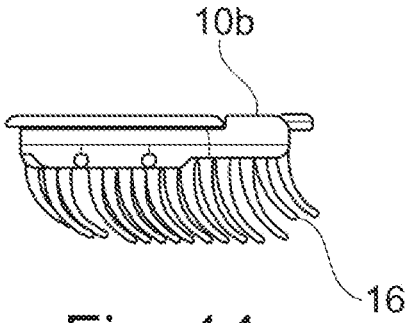
FIG. 14 is another schematic side view along XIV of the pad of FIG. 11.

As can be seen in FIGS. 11, 13 and 14, the pad 10*b* intended for cleaning keratin fibers only comprises curved barbs 16, including the barbs 16*a*, all being inclined. These barbs 16 are in this example configured to imitate the papillae of the tongue of a feline, in this example constituted by a cat. In this example, the barbs 16 are curved while being oriented toward a single imaginary point located at a distance from the pad 10*b*. The barbs 16 are arranged in a regular manner on the pad 10*b* on the outer surface 15, in rows, being distributed over the whole outer surface 15 of the pad. The barbs 16 have similar lengths and similar diameters and shapes except for the five barbs 16*a* arranged in a central row 39 on the pad 10*b*. The barbs 16 arranged close to the contour 29 have a diameter smaller than that of the barbs 16 arranged near the row 39. The barbs can have a Shore hardness of between and 100 Shore A, this hardness being able in particular to be greater than the hardness of the papillae of a cat. The length may be greater than that of the papillae of a cat by at least 20%, in particular by at least 40%, for example by 60%. Such a hardness and such a length can make it possible to comb or brush human head hair and/or to massage the scalp, in an efficient manner.

Figure 17:
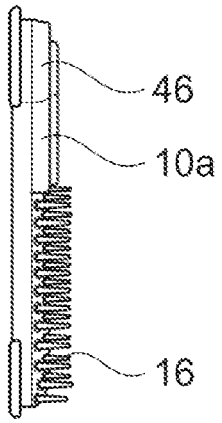
FIG. 17 shows, schematically, in a side view along XVII, the pad of FIG. 15.
Figure 18:
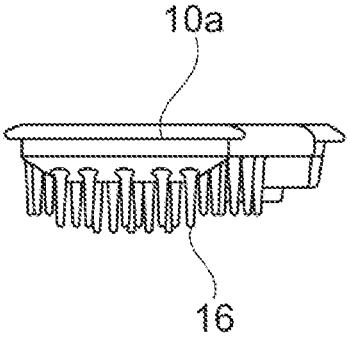
FIG. 18 shows, schematically, in another side view along XVIII, the pad of FIG. 15.

As visible in FIGS. 15, 17 and 18, the pad 10*a* intended for cleaning the skin comprises barbs 16, denoted 16*b*, of a first shape and barbs 16, denoted 16*c*, of a second shape, independently of the barbs 16*a* allowing dispensing of the cleaning composition. The barbs 16*b* and barbs 16*c* differ in this example in their diameter, the barbs 16*b* being of greater diameter than the barbs 16*c*. The barbs 16*c* are located near this contour 29, while the barbs 16*b* are closer to the barbs 16*a*. All the barbs 16 of the pad 10*a* are rectilinear, form a point, having a substantially conical shape, and extend substantially orthogonally to the pad 10*a*, being arranged parallel to one another, in particular in the form of rows parallel to one another, curved to follow the outer contour 29 of the pad 10*a*, as visible in particular in FIG. 15 or 2.

The pad 10*a* is not entirely covered with barbs 16, in this example. It comprises a region 45, located in an upper part of the pad 10*a* as visible in FIG. 2, comprising cleaning projections 7 forming lamellae 46 arranged orthogonally to the outer surface 15. Thus, during cleaning of the skin, massaging or rubbing can be carried out on the skin while applying the cleaning composition using the barbs 16, then scraping can be carried out with the lamellae 46 in order to remove for example the cleaning composition and/or dead cells and other impurities.

As can be seen in particular in FIGS. 1, 6, 7 and 9, the body 2 extends in the example illustrated from a lower end 44 to an upper end 41 along the curved longitudinal axis X. The body 2 comprises a base portion 42 including the lower end 44 and an upper portion 43 comprising the upper end 41. The width of the base portion 42 is greater than the width of the portion in the upper portion 43 in this example, the width of the upper portion 43 continually decreasing in the example illustrated in the direction of the upper end 41.

Furthermore, the body 2 has, in addition to the front part 27 comprising the complementary fixing projection 28, a rear part 47, opposite to the front part 27, defining an ergonomic gripping part. The reservoir 4 is thus delimited by the wall 3 which also partly forms the gripping part of the assembly.

There is no separate handle in this example.

It is not a departure from the scope of the invention if a separate handle is provided in the body, in addition to the reservoir, in particular if the shape of the reservoir is not ergonomic. In this case, the body may include a handle forming a bow on the upper face of the reservoir, in which handle it would be possible to engage the hand and thus press on the reservoir to release the cleaning composition instead of squeezing the reservoir in the absence of a separate handle.

The body 2 has an opening 50 for filling the cleaning composition, as can be seen in FIGS. 8 and 9. To close this filling opening 50, the stopper 12, visible in isolation in FIG. 19, is provided. The stopper 12 comprises an outer skirt 51 arranged to cover the wall 3 of the body 2 in the base portion 42 of the body 2. Furthermore, the stopper 12 comprises internally in a central part a stud 52 intended to cooperate internally with a skirt 53 defining the filling opening 50, as visible in FIG. 9, by snap-fastening or threading, so as to seal off the filling opening 50. It can be seen in FIG. 9 that the wall 3 is set back in the lower part 54 to allow the outer skirt 51 of the stopper 12 to be flush without extra thickness when the stopper 12 is fixed to the body 2, as can be seen in FIGS. 2 to 5.

To use the assembly 1 according to the invention, the reservoir 4 is filled with a cleaning composition.

A pad 10 is secured to the body 2, for example the pad 10*a* for cleaning the skin, by means of the complementary projections 26 and 28.

The elastically deformable rear part 47 of the body 2 is pressed so as to create an overpressure aimed at opening the shutters 20 of the valves 6 and to allow the cleaning composition to pass from the reservoir 4 to the dispensing openings 18 at the end of the barbs 16*a*. The skin is rubbed and massaged, for example in a circular manner, in order to clean it. The lamellae 46 then make it possible to scrape the skin in order, for example, to remove all or some of the resulting cleaning composition and impurities and dead cells.

For cleaning the keratin fibers, the procedure is the same except that the pad 10*b* is secured in place of the pad 10*a* and the barbs 16 are brought into contact with the keratin fibers so as to apply a cleaning composition to the latter and to brush or comb them or to massage the scalp.

The invention makes it possible to effectively clean the skin or the keratin fibers using the assembly 1 provided according to the invention without requiring the addition of water or requiring little addition of water, which may prove to be useful in the case of a lack of water or for a person with little or no mobility.

As a variant, the reservoir may be filled with a flexible bottle surmounted by a cone which would be inserted into a hole made in the upper face of the reservoir, possibly formed in an elastomeric skirt which opens when the bottle of cleaning composition is inserted therein and which closes when it is removed.

Figure 20:
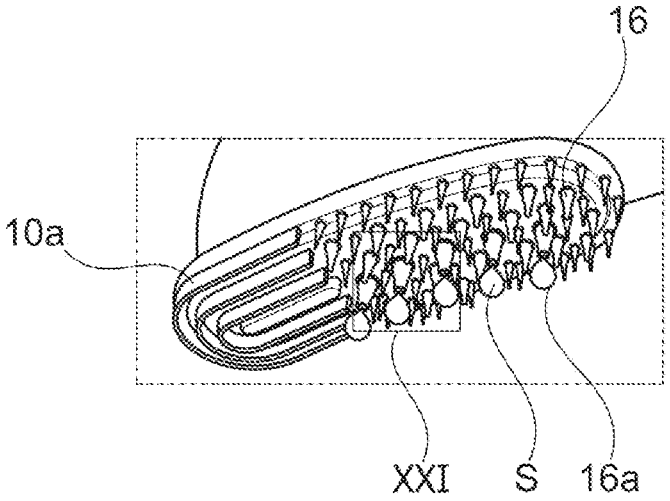
FIG. 20 shows, in perspective, schematically and partially, an example of an assembly according to the invention during its use.
Figure 21:
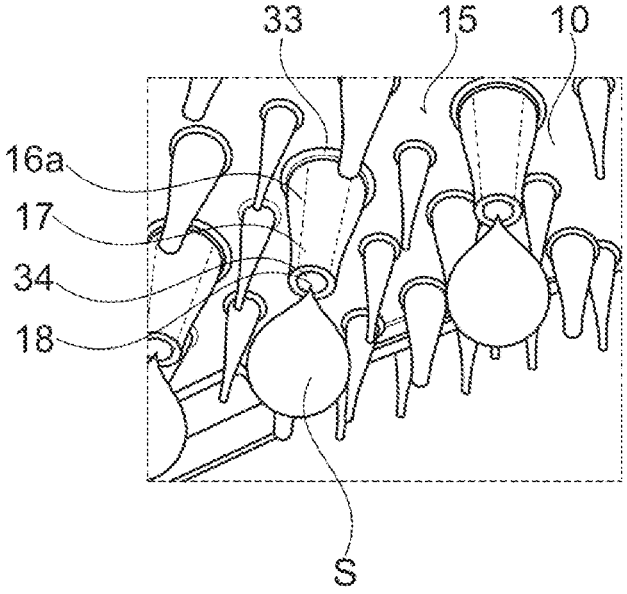
FIG. 21 is a schematic enlarged view of the detail XXI of FIG. 20.
Figure 22:
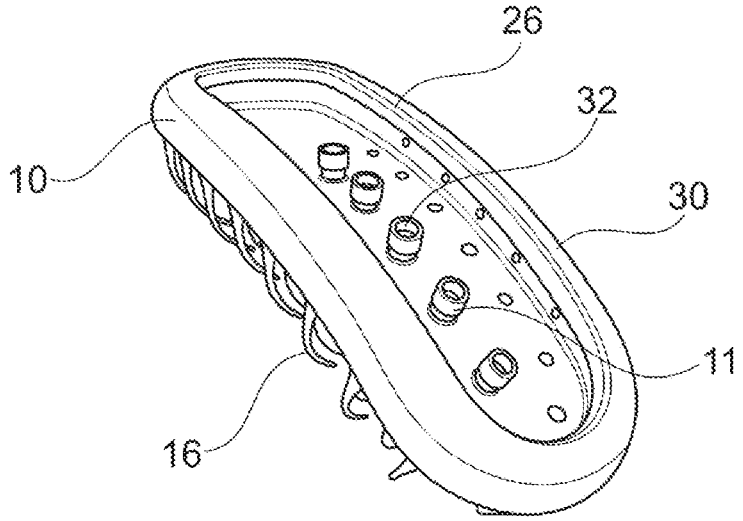
FIG. 22 shows, in isolation, schematically and in perspective, an example of a pad on the inner side of the latter.

There is shown in FIGS. 20 to 22 another embodiment of the pad 10, in which the projection 26 comprises a rim 30 extending over the entire contour of the pad, uniformly, as visible in FIG. 22.

Furthermore, in this embodiment, the retaining elements 11 are made in one piece with the pad. The cleaning composition S can be seen in FIGS. 20 and 21 coming out at the end 34 of the barbs 16*a*.

Figure 23:
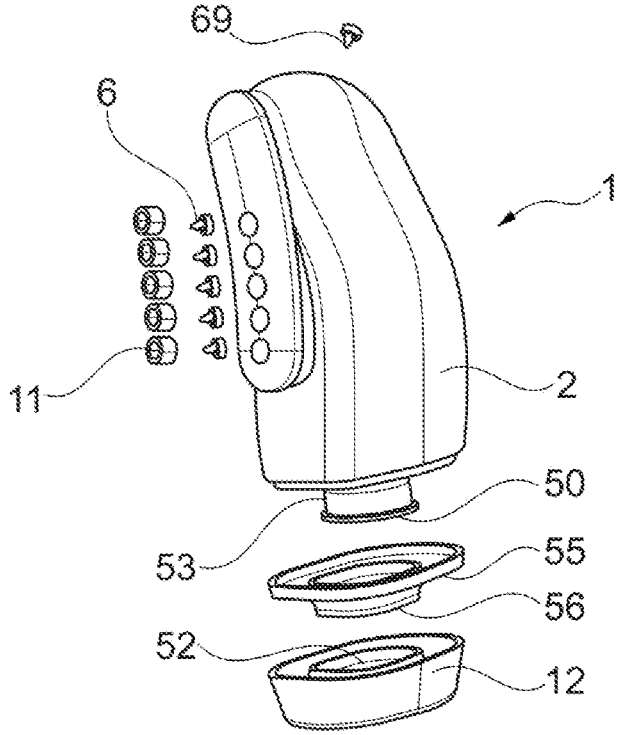
FIG. 23 shows, schematically in an exploded front view in perspective, another example of an assembly according to the invention, without the pad.
Figure 24:
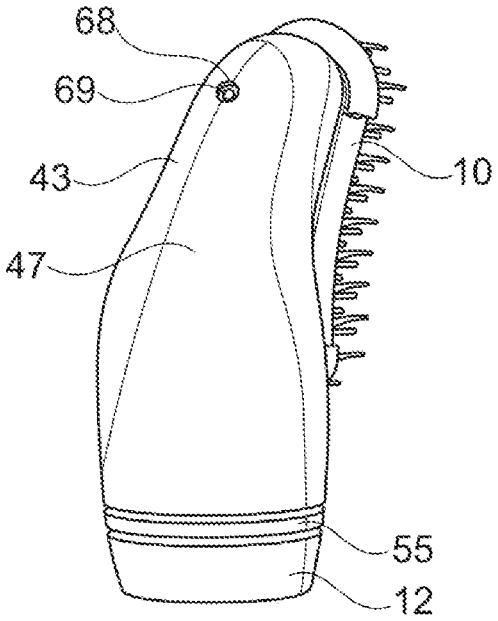
FIG. 24 shows the assembly of FIG. 23 assembled, in a schematic rear view and in perspective, with the pad.

FIGS. 23 and 24 illustrate another embodiment of the assembly 1 according to the invention. This assembly 1 differs from that illustrated in FIGS. 1 to 19 in that the body 2 comprises an air intake orifice 68, arranged in this example in the rear part 47 in the upper portion 43 of the body 2 as visible in FIG. 24. Such an air intake orifice 68 is provided with a valve 69, in this example with a valve similar to the valve 6 which equips the supply orifices 5 for the discharge of cleaning composition. In this case, the valve 69 is arranged to open when the user stops pressing on the body 2 so as to allow the entry of air into the reservoir 4. The body 2 can then regain its initial shape.

Furthermore, in the embodiment of FIGS. 23 and 24, the filling opening 50 is defined by the skirt 53 extending outside the reservoir 4, downward.

An adapter piece 55 is interposed between the stopper 12 and the body 2 so as to allow the stopper 12 and the body 2 to cooperate with each other. The adapter piece 55 is mounted by force or by snap-fastening on the skirt 53 extending outside the reservoir 4. The adapter piece 55 itself comprises a skirt 56 extending substantially parallel to the skirt 53 of the body 2 and having an external thread capable of cooperating with a corresponding thread present on the central stud 52 of the stopper 12 in order to be able to close the filling opening 50. As can be seen in FIG. 24, the adapter piece 55 is provided to be flush with the surface of the body 2, like the stopper 12.

Figure 25:
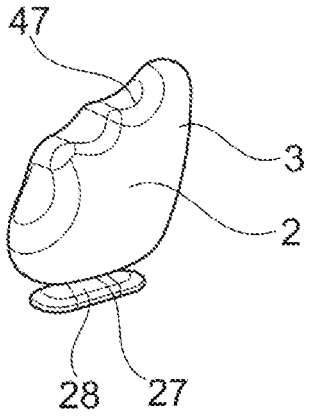
FIG. 25 shows, in isolation, schematically and in perspective, another example of a body which can form part of the assembly according to the invention.
Figure 26:
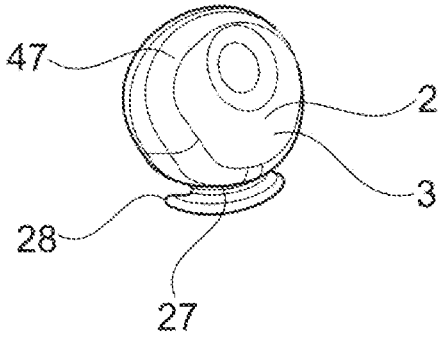
FIG. 26 shows, in isolation, schematically and in perspective, another example of a body which can form part of the assembly according to the invention.
Figure 27:
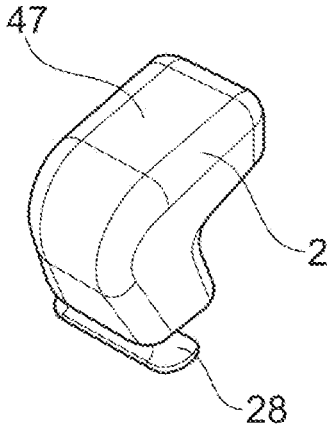
FIG. 27 shows, in isolation, schematically and in perspective, another example of a body which can form part of the assembly according to the invention, and FIG. 28 schematically shows an example of a method for manufacturing an assembly according to the invention.

Three other possible body shapes 2 have been shown in FIGS. 25 to 27.

In FIG. 25, the rear part 47 forming the gripping part substantially reproduces the relief of the hand and the fingers.

FIG. 26 illustrates a body 2 of generally rounded shape in its rear part 47, with a hollow.

Finally, FIG. 27 illustrates a body 2 forming an elbow in the direction of the rear part 47.

Figure 28:
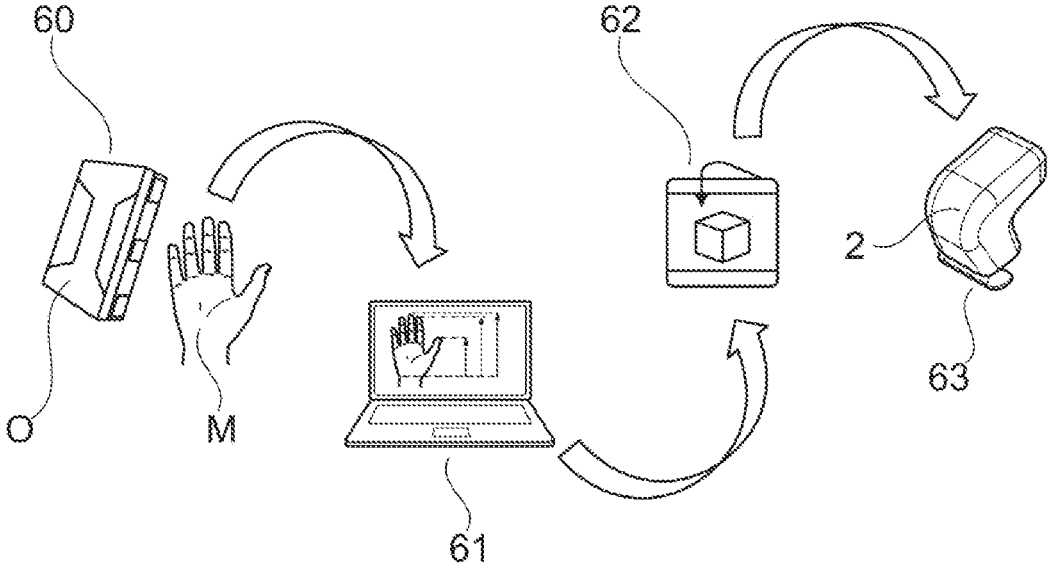

In FIG. 28, various steps have been shown of an example of a method for manufacturing a body 2 for an assembly 1 according to the invention.

The first step 60 consists in taking an image, in this example to be scanned, of a hand M of a user using a device O. In a second step 61, the images from the first step 60 are processed, so as to define an appropriate profile of the wall 3 of the body 2. In a third step 62, the body 2 is produced by additive manufacturing of polymer material. In a fourth step 63, the desired body 2, adapted to the user, is thus obtained.

It should be noted that, in this method as well as for the examples of FIGS. 26 to 28, the front part 27 and the complementary projection 28 always remain identical and are not adapted, so that the body 2, whatever its shape, can be assembled with any pad 10.

Needless to say, the invention is not limited to the examples that have just been described.

In particular, the shape of the body 2 can be modified without departing from the scope of the invention.

The fixing 26 and complementary 28 projections may be different from those which have been described above while making it possible to cooperate with one another for the removable fixing of the pad 10 to the body 2, without departing from the scope of the invention.

The cleaning projections 7 may not comprise barbs 16. The dispensing opening 18 may not be formed in a barb 16 but be present at the outer surface 15 of the pad 10 or be formed in a cleaning projection 7 other than a barb. In this case, the dispensing opening 18 is nevertheless intended to be positioned on the pad 10 so as to allow the cleaning composition to exit from the reservoir 4 to the dispensing opening 18 by passing through the supply orifice 5.

The diameter of a barb 16 may be between 0.5 mm and 3 mm, preferably being around 1 mm approximately.

In a variant, the presence of the pad is necessary to unlock the valves and allow them to open under the pressure of the cleaning composition.

In another variant, the pad constrains the opening of the valves, so that, depending on the pad placed on the body, the valves can open more or less.

The invention claimed is:

1. An assembly for cleaning skin and/or keratin fibers, comprising:

(i) at least one body adapted to contain at least one cleaning composition for the skin and/or the keratin fibers, the at least one body comprising at least one wall delimiting a volume forming at least one reservoir for housing the at least one cleaning composition, the at least one wall having at least one elastically deformable part, and a plurality of supply orifices for allowing the at least one cleaning composition to exit the at least one body;

(ii) a plurality of valves, each valve for closing a respective supply orifice, (iii) at least one pad adapted to contact the skin and/or the keratin fibers, wherein the at least one pad is capable of being removably fixed to the at least one body, and having an outer surface comprising a plurality of cleaning projections and at least one dispensing opening, the plurality of supply orifices and the at least one dispensing opening being positioned respectively on the at least one body and the at least one pad so that, when the at least one pad is fixed to the at least one body, the at least one cleaning composition can pass from the at least one reservoir to the at least one dispensing opening by passing through the plurality of supply orifices when the respective plurality of valves are open.

2. The assembly according to claim 1, wherein the at least one pad comprises at least two different pads suitable for being fixed alternatively to the at least one body, wherein at least one of the pads is capable of cleaning the skin and at least one of the pads is capable of cleaning keratin fibers, the plurality of cleaning projections of the pad provided for cleaning the skin being at least in part different from the plurality of cleaning projections of the pad provided for cleaning keratin fibers.

3. The assembly according to claim 1, wherein the plurality of valves are configured to allow the at least one cleaning composition to be retained in the at least one reservoir in the absence of pressure exerted on the at least one elastically deformable part of the at least one wall, and wherein the at least one cleaning composition is capable of exiting the at least one reservoir when pressure is exerted on the at least one elastically deformable part of the at least one wall.

4. The assembly according to claim 1, wherein each valve of the plurality of valves has a corresponding base of annular shape and at least one shutter fixed to each corresponding base, wherein the plurality of valves comprises at least two elastically deformable membranes that cooperate in the absence of pressure to prevent any exit of the at least one cleaning composition from the at least one reservoir, wherein the plurality of valves comprises an opening between them, wherein the at least one cleaning composition is capable of exiting from the at least one reservoir when pressure is exerted on the elastically deformable part of the wall of the at least one body.

5. The assembly according to claim 1, further comprising a plurality of retaining elements arranged to cause each valve of the plurality of valves to cooperate with a respective supply orifice of the plurality of supply orifices, wherein each retaining element of the plurality of retaining elements comprises a ring of an external diameter substantially equal to that of the respective supply orifice and of an internal diameter substantially equal to the external diameter of a part of the valve, wherein the external surface of each retaining element is capable of maintaining its respective valve and the internal surface is capable of cooperating with the respective supply orifice.

6. The assembly according to claim 1, wherein the at least one body is made of an elastically deformable material.

7. The assembly according to claim 1, wherein the at least one pad comprises at least one fixing projection on an inner surface opposite to the outer surface, wherein the at least one body comprises at least one complementary fixing projection on an outer face that is capable of cooperating with the at least one fixing projection of the at least one pad, wherein each fixing projection is capable of fixing the at least one pad to the at least one body.

8. The assembly according to claim 1, wherein the plurality of supply orifices is arranged in a row extending from the middle of the at least one pad when the at least one pad is fixed to the body.

9. The assembly according to claim 8, wherein the at least one pad extends along a curved longitudinal axis, the row being curved with a curvature substantially similar to the curved longitudinal axis of the at least one pad and the at least one body comprising at least one part capable of cooperating with the at least one pad and a similar curved shape.

10. The assembly according to claim 1, wherein the plurality of cleaning projections comprises a plurality of barbs.

11. The assembly according to claim 10, wherein at least one barb of the plurality of barbs has at least one passage opening onto the at least one dispensing opening, wherein the at least one passage passes through the at least one barb from one end connected to the outer surface of the at least one pad to a free end of the at least one barb, the free end comprising a respective dispensing opening of the at least one dispensing openings.

12. The assembly according to claim 10, wherein the plurality of barbs comprises barbs of at least one first shape and barbs of at least one second shape, differing in particular from the first shape in diameter, shape of a free end, length, and/or a straight or curved longitudinal axis along which the plurality of barbs extends between an end connected to the outer surface of the pad and the free end.

13. The assembly according to claim 10, wherein at least some of the barbs of the plurality of barbs of the pad have a curved shape, the longitudinal axis of the at least some of the barbs then being curved.

14. The assembly according to claim 10, wherein at least some of the barbs of the plurality of barbs of the pad have a rectilinear shape.

15. The assembly according to claim 1, wherein the at least one body comprises at least one filling opening for filling the at least one cleaning composition, the at least one assembly comprising an at least partially removable stopper arranged to close the at least one filling opening.

16. The assembly according to claim 1, wherein each valve of the plurality of valves comprises an axis that is oriented perpendicularly to a longitudinal axis of the at least one body.

17. The assembly according to claim 1, wherein the at least one pad comprises a longitudinal axis, wherein the at least one body comprises a longitudinal axis, and wherein the longitudinal axis of the pad and the longitudinal axis of the body make an angle less than 45°.

18. The assembly according to claim 1, wherein each supply orifice of the plurality of supply orifices comprises a respective dispensing opening of the at least one dispensing openings.

19. The assembly according to claim 1, wherein the plurality of valves remains attached to the at least one body in the absence of the at least one pad.

20. A method for cleaning skin and/or keratin fibers with the assembly according to claim 1, comprising:

filling the at least one reservoir with the at least one cleaning composition;

pressing the at least one body to allow an opening of the plurality of valves and a dispensing of the at least one cleaning composition through at least one dispensing opening;

bringing a plurality of cleaning projections and the at least one cleaning composition into contact with the skin and/or the keratin fibers, and optionally, massaging, combing, brushing or rubbing the skin or keratin fibers with the at least one cleaning projection wetted with the at least one cleaning composition.

* * * * *